US006145759A

United States Patent [19]

Susa

[11] Patent Number: 6,145,759

[45] Date of Patent: Nov. 14, 2000

[54] SUCTION-EFFECT RADIAL-DISCHARGE FUNNEL-SHAPED NOZZLE

[75] Inventor: Janez Susa, Cesta v Lipovce 33A, Ljubljana-Brezovica 1351, Slovenia

[73] Assignee: Janez Susa, Ljubljana-Brezovica, Slovenia

[21] Appl. No.: 09/180,329

[22] PCT Filed: Apr. 16, 1997

[86] PCT No.: PCT/SI97/00014

§ 371 Date: Nov. 5, 1998

§ 102(e) Date: Nov. 5, 1998

[87] PCT Pub. No.: WO97/41962

PCT Pub. Date: Nov. 13, 1997

[30] Foreign Application Priority Data

May 6, 1996 [SI] Slovenia ..... 9600143

[51] Int. Cl.[7] ..... B05B 1/26

[52] U.S. Cl. ..... 239/518

[58] Field of Search ..... 239/506, 518, 239/432

[56] References Cited

U.S. PATENT DOCUMENTS

| | | | |
|---|---|---|---|
| 2,393,328 | 1/1946 | Mahone | 239/506 X |
| 2,543,996 | 3/1951 | Turner | 239/506 X |
| 3,731,876 | 5/1973 | Showalter | 239/506 X |
| 3,737,105 | 6/1973 | Arnold et al. | 239/518 X |
| 4,044,079 | 8/1977 | Tveit . | |
| 4,162,971 | 7/1979 | Zlokarnik et al. . | |
| 4,534,862 | 8/1985 | Zlokarnik . | |

FOREIGN PATENT DOCUMENTS 6226145 9/1994 Japan .

OTHER PUBLICATIONS

Walter et al., "Vergleich von Gegasungs– und Entspannungsflotation bei der Partikelabscheidung aus Emulsionen and Suspensionen", GWF Wasser Abwasser, vol. 136, No. 2, Feb. 1, 1995, pp. 53–61.

*Primary Examiner*—Lesley D. Morris
*Attorney, Agent, or Firm*—Jacobson, Price, Holman & Stern, PLLC

[57] ABSTRACT

The invention relates to a suction-effect radial-discharge funnel-shaped nozzle. It comprises, in series, an injector (2) to supply a fluid and a spreading cone (1), whose tip resides in front of a discharge mouth of said injector, as well as a funnel-shaped housing (3) encasing them. According to the invention, the discharge annulus of the nozzle is reduced along the mantle surface of the cone starting from the tip thereof, with a constant annular flow area being maintained along the flow.

1 Claim, 3 Drawing Sheets

Figure 1:
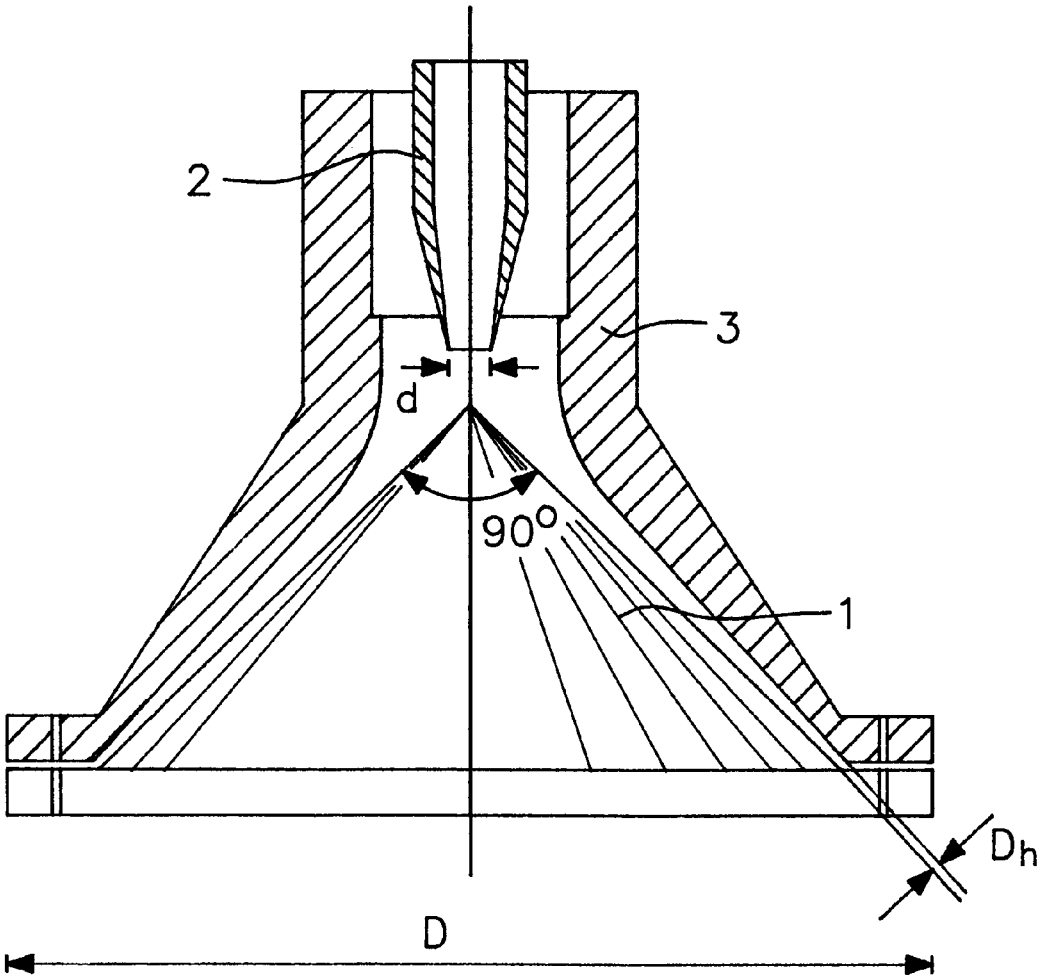

| | A | B | C |
|---|---|---|---|
| D (mm) | 60–240 | 100 | 200 |
| $D_h$ (mm) | 5 | 3.6* | 5.7* |
| d (mm) | 5–20 | 5 | 10 |

SUCTION-EFFECT RADIAL-DISCHARGE FUNNEL-SHAPED NOZZLE

The invention relates to a suction-effect radial-discharge funnel-shaped nozzle comprising, in series, an injector to supply a fluid and a spreading cone, whose tip resides in front of a discharge mouth of the said injector, as well as a funnel-shaped housing encasing them.

Nozzles of the type as set forth above serve for dividing, distributing, dispensing and/or dispersing a gas in a fluid e.g. in flotation plants.

A nozzle of the above type is known from EP 0 035 243. The known nozzle is characterized by a convergent-divergent mixing chamber having a constant hydraulic diameter, so that by increasing the circumference a diffuser is created. It is characteristic of the known nozzle that by means thereof no such quantity of gas can be sucked that the ratio of the flows of the fluid and of the sucked gas would be 1 nor is it possible to produce bubbles of a relatively small magnitude (about 150 microns). In practice, all these features of the known nozzle together limit the possibilities of use for the nozzle.

It is an object of the present invention to modify the above-mentioned comparable design of a nozzle so that its sucking characteristics will be altered to result in a significantly broader field of use.

When searching for a solution to improve the characteristics of the funnel-shaped nozzle it was surprisingly found that the suction effect of the nozzle was markedly higher if an annulus between a cone-shaped spreading element and a housing was continuously reduced towards the exit. The reduction of the said annulus was such that the annular flow area along the cone was maintained constant.

As to the term "hydraulic diameter" mentioned above:

A quotient of an area of stream cross section and a wetted perimeter is called hydraulic radius. A hydraulic diameter is a product of four hydraulic radii.

Figure 2:
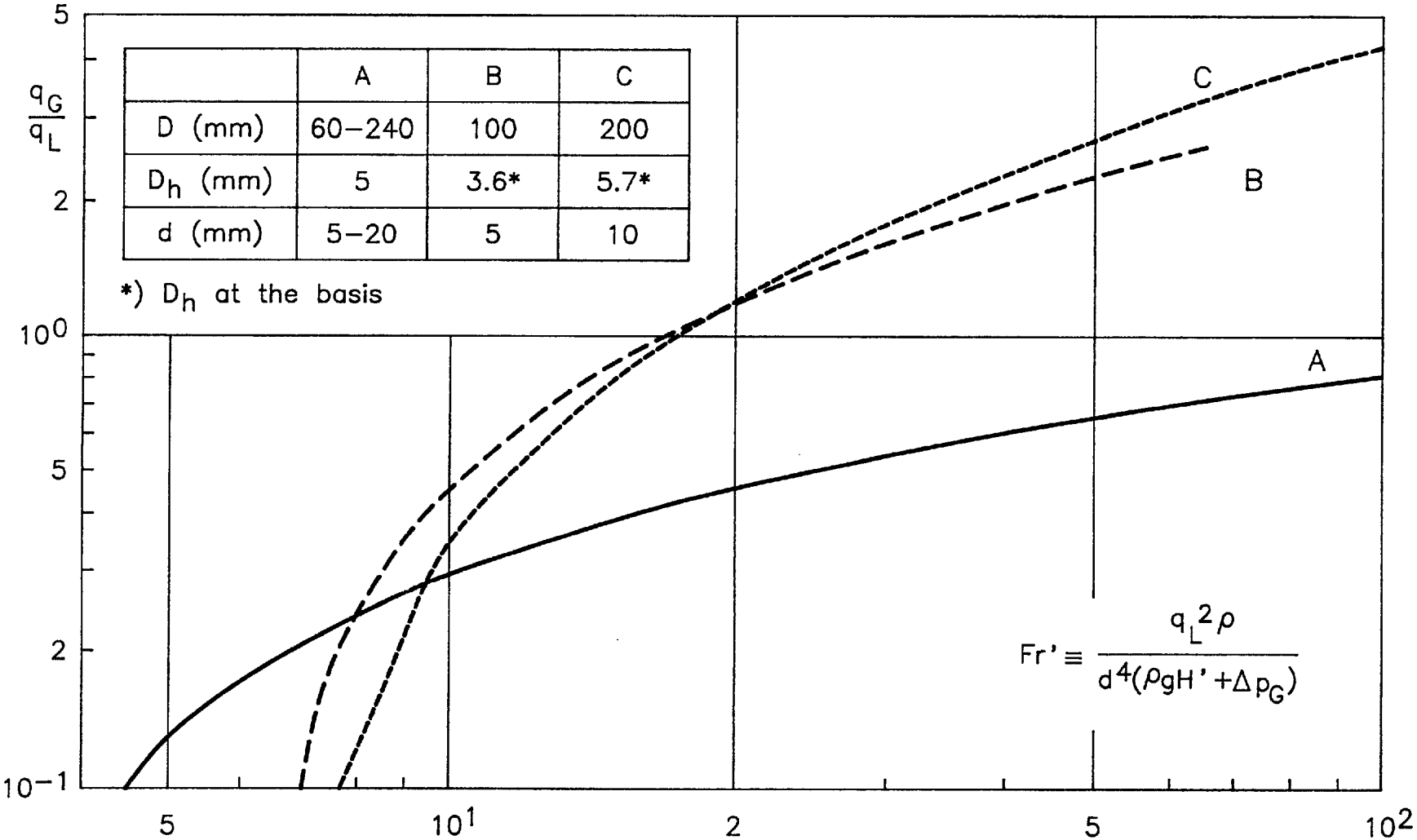
Figure 3:
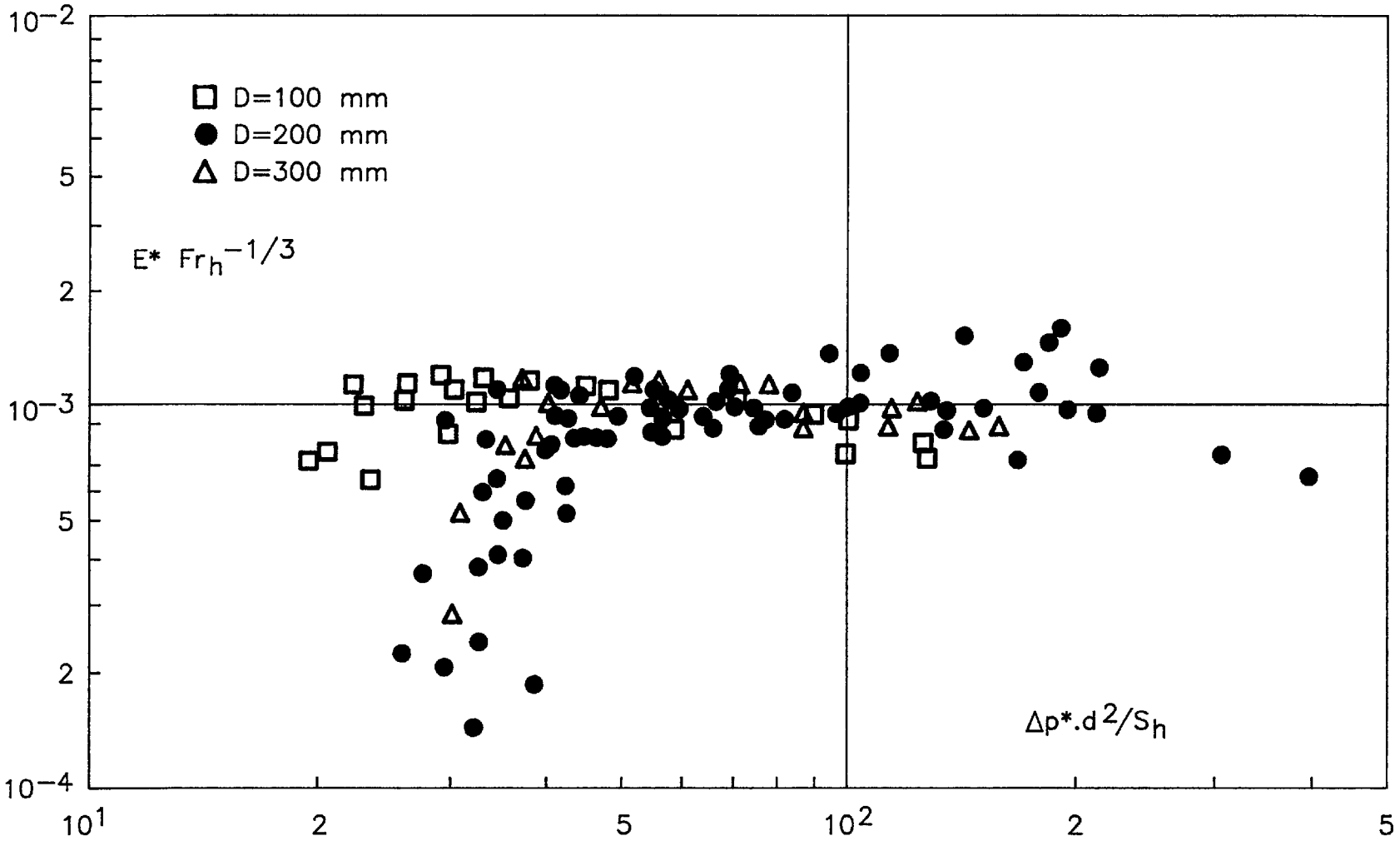

Hereinafter, the invention is disclosed in more detail by means of an embodiment shown in the drawing. In the drawing:

FIG. 1 is partly an elevational axial section and partly an elevational View of the inventive nozzle, FIG. 2 is a graph of suction effect characteristics, and FIG. 3 is a graph of nozzle capacities.

Basically, the nozzle is composed of three mutually coaxial component members: a spreading cone 1 having a tip angle of 90°, an injector 2 of an inner diameter d for supplying a liquid, and a shaped housing 3 common to both first-mentioned members. A part of the housing 3 residing at the injector 2 together with the latter forms an annulus for supplying a gas, and a part of the housing 3 residing at the cone 1 together with the mantle surface of the latter forms an annulus for discharging the fluid/gas dispersion.

The fundamental feature of the invention i.e. that the flow area of the annulus between the cone 1 and the housing 3 is constant in axial direction, can be carried out according to the invention by a plurality of approaches. In the embodiment shown the cone 1 is an elementary geometrical body so that a spacing of an inner mantle surface of the funnel-shaped part of the housing 3 is defined depending on the mantle surface of the said cone. In the arrangement as shown the said spacing equals $D_h$ at the location where it is smallest i.e. prior to entering a radial gap of the nozzle.

Added to the cone 1 and the housing 3, respectively, are D-diameter flanges that mutually define a radial discharge gap of the nozzle.

Pressurized water is supplied through the injector 2 onto the tip of the cone 1. A low pressure is established in a hole existing between the injector 2, the cone 1 and the housing 3, which results in suction of gas through the housing 3 into the spread flow of the fluid. From here on the fluid and the gas flow in the form of a fluid/gas dispersion.

FIG. 2 diagrammatically shows relations between the Froude numbers (Fr') and the quotients of a gas flow ($q_G$) and a liquid flow ($q_L$) more specifically the suction effect characteristics of funnel-shaped nozzles. Line A indicates the characteristics of an embodiment having a constant hydraulic diameter (prior art) and lines B and C indicate the characteristics of a nozzle having a constant flow area of an annulus according to the invention. Evidently, the ratio of the gas flow vs. liquid flow according to the invention is not only increased to 1, but increased for a factor of about 4.

FIG. 3 shows a $\Delta p^* \cdot d^2/S_h$ vs. $E^* Fr_h^{1/3}$ diagramm with the symbols explained below. The tests made by using several funnel-type nozzles (D=100 mm, 200 mm, 300 mm) of the respective design confirmed the proposition that beyond a certain critical value all funnel-type nozzles having a constant flow area operate equally well.

The symbols used in FIGS. 2–3 have the following meaning:

$$D_h = D_a - D_i$$

$$S_h = D_a^2 - D_i^2$$

$$Fr_h = q_L \cdot \rho / d^4 (\rho g H + \Delta p_G)$$

$$\Delta p^* = \Delta p_L / (\rho g H' + \Delta p_G)$$

$$E^* = q_G (\rho g H' + \Delta p_G) / q_L \cdot \Delta p_L$$

$D_a$ outer diameter $D_i$ inner diameter $q_G$ gas flow $q_L$ liquid flow

ρ liquid density g acceleration of gravity

H extent of water column over nozzle $\Delta p_G$ gas-side pressure drop $\Delta p_L$ liquid-side pressure drop

What is claimed is:

1. A suction-effect radial-discharge funnel-shaped nozzle comprising:

a housing having a pipe section and a funnel-shaped section having an inner surface, said pipe section connectable to a gas supply;

an injector co-axially positioned within said pipe section for supplying a fluid to be mixed with the gas supplied to said pipe section, said injector including a discharge orifice;

a cone for spreading the fluid/gas mixture prior to radial discharge from the nozzle, said cone having a cone tip, a cone base, and an outer surface arranged so that said cone tip is positioned in front of said discharge orifice of said injector, and wherein said funnel-shaped section of said housing encases said cone to define an annular gap between said inner surface of said funnel-shaped section and said outer surface of said cone, the width of said gap being continuously reduced in the direction from said tip to said base of said cone to maintain a constant annular flow area between the cone and the funnel-shaped section in the direction of flow from cone tip to cone base.

* * * * *